United States Patent [19]

Kubo

[11] Patent Number: 4,640,765

[45] Date of Patent: Feb. 3, 1987

[54] METHOD FOR CRACKING HEAVY HYDROCARBON OILS

[75] Inventor: Junichi Kubo, Yokohama, Japan

[73] Assignee: Nippon Oil Co., Ltd., Tokyo, Japan

[21] Appl. No.: 770,734

[22] Filed: Aug. 29, 1985

[30] Foreign Application Priority Data

Sep. 4, 1984 [JP] Japan ..... 59-183673
Apr. 11, 1985 [JP] Japan ..... 60-75364

[51] Int. Cl.[4] ..... C10G 47/32; C10G 47/34

[52] U.S. Cl. ..... 208/110; 208/111; 208/112; 208/56; 208/251 H; 422/222

[58] Field of Search ..... 208/106, 107, 108, 56, 208/147, 126, 251 H, 251 R, 165, 166, 110, 111, 112; 422/222

[56] References Cited

U.S. PATENT DOCUMENTS

| | | | |
|---|---|---|---|
| 1,890,439 | 12/1932 | Pier | 208/107 |
| 2,968,610 | 1/1961 | Bergstrom | 208/108 |
| 3,573,201 | 3/1971 | Annesser et al. | 208/251 H |
| 3,817,856 | 6/1974 | Aaron et al. | 208/213 |
| 4,062,757 | 12/1977 | Beuther et al. | 208/61 |
| 4,389,303 | 6/1983 | Simo et al. | 208/107 |
| 4,395,324 | 7/1983 | Derbyshire et al. | 208/56 |
| 4,409,093 | 10/1983 | Bearden, Jr. et al. | 208/108 |
| 4,425,224 | 1/1984 | Vernon | 208/56 |
| 4,451,354 | 5/1984 | Stuntz | 208/56 |
| 4,473,658 | 9/1984 | Schwartz | 502/45 |
| 4,485,004 | 11/1984 | Fisher et al. | 208/112 |
| 4,487,687 | 12/1984 | Simo et al. | 208/56 |

FOREIGN PATENT DOCUMENTS

| | | | |
|---|---|---|---|
| 553169 | 2/1958 | Canada | 208/56 |
| 1073389 | 3/1980 | Canada | 208/126 |

*Primary Examiner*—Brian E. Hearn
*Assistant Examiner*—O. Chaudhuri
*Attorney, Agent, or Firm*—Bucknam and Archer

[57] ABSTRACT

A method for cracking a heavy fraction oil is provided in which is solved a problem as to an increase in pressure loss due to coking in a cracking tower during the treatment of heavy fraction oils containing at least 1.0 wt. % of asphaltene. The cracking tower is vertically divided into at least two portions with a partition for housing a solid catalyst having a hydrogenation function, and the divided portions are communicated with each other at the upper and lower parts of the tower. A starting heavy fraction oil, a hydrogen donative solvent, and a hydrogen-containing gas are introduced into at least one of the divided portions at the lower part thereof, and further the fluid is circulated between the divided portions. Another method for cracking heavy fraction oils is provided in which a heavy hydrocarbon oil containing at least 1.0 wt. % of asphaltene is hydrogenated, a starting heavy fraction oil is cracked in the presence of at least one kind of a solid material selected from solid catalysts and porous solids and of a hydrogen donor, and at least 50 wt. % of heavy metals contained in the starting heavy fraction oil is ahdered to the solid material, and a reaction product mixture from the first step is separated from the solid material and then hydrogenated in the presence of hydrogen gas and a hydrogenating catalyst.

17 Claims, 10 Drawing Figures

METHOD FOR CRACKING HEAVY HYDROCARBON OILS

BACKGROUND OF THE INVENTION

1. Field of the Invention

The present invention relates to a method for hydrocracking heavy fraction oils, particularly those containing asphaltene, i.e., 10 wt. % or more of pentane-insoluble ingredients.

2. Prior Art

Recently, hydrogenolysis of heavy fraction oils has increasingly been of importance. There have been proposed many methods for thermal cracking, catalytic cracking, and hydrogenolysis, etc.

The heavy fraction oils referred to herein are hydrocarbon oils containing 50 wt. % or more of a fraction boiling above 350° C., particularly those containing 1.0 wt. % or more of pentane-insoluble ingredients. For example, they include residual oils yielded by atmospheric or vacuum distillation of crude oils, or oils produced from coal, oil sand, oil shale, bitumen or the like. The term "cracking" herein is intended to obtain light fraction oils including naphtha and gasoline fractions, and, kerosene and light oil fractions.

In the general hydrogenation treatment of heavy fraction oils, the reduction of catalytic activity is the most serious problem technically or economically. Namely, the heavy fraction oil contains an asphaltene fraction which contains heavy metals such as vanadium and nickel. These metals severely deteriorate catalysts and hinder economical and continuous long-term uses of the catalysts. Many efforts for improving catalysts have been exerted to solve such a problem, and many improved catalysts have been proposed but they are not completely satisfactory. In addition, there have been proposed many elaborate contributions to improve a reaction apparatus, however, there have been left many problems to be solved.

Moreover, the cost of hydrogen is an important factor economically and technically. In the hydrotreatment of heavy fraction oils, the amount of consumption of hydrogen may be increased as a starting oil is heavier, thus costing a great deal.

As one of methods which solve the problem of such hydrogen cost, there is known a method in which a hydrogen donor compound yielded by hydrogenating a polycyclic aromatic compound is used (for example, U.S. Pat. No. 4,430,197). When the hydrocracking of a heavy fraction oil is effected with use of such a hydrogen donor compound, it is also well known that a catalyst is not necessarily needed and the hydrocracking reaction proceeds in an atmosphere of hydrogen gas at a relatively low pressure (for example, U.S. Pat. No. 4,294,686 and Oil & Gas Journal, Nov. 22, 1982, Pages 111 through 116).

The hydrogen donor solvent described above is a compound yielded by hydrogenating a hydrocarbon compound having polycyclic aromatic rings such as naphthalene and anthracene. It is well known that such a hydrogen donor liberates a hydrogen atom at high temperatures (for example, above 380° C.). There have also been accordingly proposed many trials to take advantages of said liberation nature industrially (for example, U.S. Pat. No. 2,953,513). It is also well known that such a hydrogen donor material is included in a thermally cracked oil, catalytically cracked oil, and hydrogenated oil from a heavy fraction oil, serving as an effective hydrogen donor in itself (for example, U.S. Pat. No. 3,970,545).

However, the cracking reaction in these methods is effectively performed only at relatively high temperatures, resulting in deposition of carbonaceous materials to cause a problem of what is called coking.

SUMMARY OF THE INVENTION

In view of the drawbacks of the conventional methods for hydrogenating heavy fraction oils, it is an object of the present invention to provide a more effective method for cracking heavy fraction oils in which is solved the problem as to an increased pressure loss caused by coking in a cracking tower (reaction tower) when treating the heavy fraction oils containing 1.0 wt. % or more of asphaltene.

It is another object of the present invention to provide a method for cracking heavy fraction oils containing 1.0 wt. % or more of asphaltene with little reduction of catalyst activity, reduced consumption of hydrogen and high cracking efficiency.

According to the present invention, the interior of a cracking tower is vertically divided into at least two portions with a partition for housing a solid catalyst having a hydrogenation function, and the divided portions are communicated with each other at the upper and lower parts thereof. The starting heavy fraction oil, a hydrogen donor solvent, and a hydrogen-containing gas are introduced into at least one of the divided portions at the lower part of said at least one portion, and further the fluid so introduced is circulated between the divided portions.

The method described above serves to relieve the problem of coking, and to effectively crack heavy fraction oils.

It should be noted here that cracking with use of a hydrogen donor does not require a catalyst and it can be effected without a catalyst in many cases. The present inventor has found the following facts experimentally:

(1) Upon cracking heavy oils with use of a hydrogen donor, cracking can be effectively achieved due to the presence of a slight catalytic action.

(2) At this point, the presence of the slight catalytic action greatly inhibits the formation of carbonaceous materials.

(3) The "slight catalytic action" described above can be effected not only by the presence of a catalyst having relatively high activity, for example a commercially available one, in a small quantity relative to the amount of starting oil used, but also by the presence of a catalyst having relatively low activity.

(4) As a countermeasure against troubles such as an increase in pressure loss due to production of carbonaceous materials, and blockade or clogging, it is effective to increase the flow rate of the fluid.

Namely, when cracking heavy fraction oils with the aid of a hydrogen donor, the presence of a slight catalytic action is effective, for which a solid catalyst can be the most conveniently used. Although the solid catalyst may be used in a fixed bed form, its use is likely to cause blocking or clogging. With such form, the flow rate of a fluid is insufficient, and the fluid and gas are prevented from flowing due to carbonaceous materials produced, resulting in accumulation of the carbonaceous materials followed by causing blocking. To avoid this, it is considered to fluidize the catalyst for use. However, when heavy fraction oils are generally cracked using a hydrogen donor solvent, the catalyst in the form of very fine particles should be employed to produce a uniform flow of the catalyst with use of the starting oil, the hydrogen donor and the gas. With the use of such fine particles, it is difficult to separate these particles from the resulting reaction products. When there are used relatively large particles (for example, more than 0.1 mm) which may be separated from the reaction products, a high fluid flow rate is required to fluidize these particles. However, it is impossible to obtain such a high flow rate only by the use of the starting oil and the hydrogen donor. Accordingly, for this purpose, it is necessary to recycle the reaction products. The recycling will be the cause for complication of an apparatus to be installed and for an increase in construction cost.

According to the present invention, a required flow velocity can be obtained by causing a natural circulating flow in a cracking tower and thereby avoiding any clogging with carbonaceous materials, while an effective cracking reaction may be carried out by placing a catalyst having a hydrogenating function in the cracking tower thereby causing the cracking reaction effectively and enabling the production of carbonaceous materials to be greatly reduced.

Another method for hydrocracking heavy hydrocarbon oils containing 1.0 wt. % or more of asphaltene, comprises the two steps (1) and (2):

(1) a starting heavy fraction oil is cracked in the presence of at least one kind of a solid material selected from the group consisting of solid catalysts and porous solids, and a hydrogen donor solvent; and at least 50 wt. % of heavy metals contained in the starting oil is caused to adhere to the solid material, and (2) the reaction product mixture from the aforesaid stage (1) which is separated from the solid material to which the heavy metals have adhered at the cracking tower, and then hydrogenated in the presence of hydrogen gas and a hydrogenation catalyst; after which (3) the reaction product mixture from the second step is sorted into a fraction including the hydrogen donor solvent, and other desired fractions, and the fraction including the hydrogen donor is recycled to the first step.

One characteristic of the cracking method just described above according to the present invention, is to treat heavy fraction oils in the two steps by the use of the hydrocracked oil functioning itself as a hydrogen donor since the hydrocracked oil contains the original hydrogen donor compound. The present inventor has revealed that when heavy fraction oils were cracked with use of a hydrogen donor solvent, metals such as vanadium and nickel are in a state in which they are apt to be removed. Consequently, by cracking heavy fraction oils with use the hydrogen donor solvent and removing metals in the first step, there are obtained oils which have been cracked to some extent while the metals have been almost removed therefrom. Thus, in the second step, the reduction of catalytic activity may be remarkably lessened and the operational conditions are enabled to be remarkably mild.

The methods according to the present invention will be described below with reference to the accompanying drawings in which:

FIGS. 1 through 3 are respectively longitudinal and housing a solid catalyst with a hydrogenating function. The partition 2 in FIG. 1 is cylindrically shaped around the tube 1. The partition 2 in FIG. 2 comprises two plates around the introduction tube 1. The partition 2 in FIG. 3 is plate-shaped, on one side of which is provided the introduction tube 1. Numeral 3 is a foamy hydrogen-containing gas rising in a cracking tower, 4 an outlet pipe for discharging cracked fluid (produced by cracking) and the hydrogen-containing gas, and 5 a cracking tower.

In FIG. 1(*a*), H indicates the height of the cracking tower 5, h the height of the cylindrical partition 2, Di the inside diameter of the cracking tower 5, do the outside diameter of the cylindrical partition 2, di the inside diameter of the cylindrical partition 2, and 1 the distance between the lower end part of the cylindrical partition 2 and an air space in the cracking tower 5.

In FIG. 2, two of the plate-shaped partitions 2 are provided around the introduction pipe 1 and the outlet pipe 4. Both side ends of each of the partition are substantially brought into contact with the side surface of the cracking tower 5, and the upper and lower side ends thereof are communicated with each other on the upper and lower parts.

In FIG. 3, one sheet of the plate-shaped partition 2 is employed to provide the introduction pipe 1 and the outlet pipe 4 on one side. Both of the side ends of the partition 2 are brought into contact with the wall surface of the cracking tower 5, and the upper and lower side ends are communicated with each other at the upper and lower parts thereof. FIGS. 4(*a*) and (*b*) exemplarily show partitions 2 usable in the present invention, (a) a cylindrical one 2 and (b) a plate-shaped one 2.

Next, the method according to the present invention will be described below with reference to FIG. 1.

A starting oil, a hydrogen donative solvent and a hydrogen-containing gas are introduced through the introduction pipe 1 provided on the lower part of the cracking tower 5. The interior of the cracking tower 5 is vertically divided into two parts by the cylindrical partition 2 including a solid catalyst housed therein, and the aforesaid two parts are communicated with each other on the upper and lower parts of the partition 2. It is preferable for the introduced hydrogen-containing gas 3 to be introduced toward the inner part of the cylindrical partition 2 so as not to flow into the outside portion of the partition 2. The same is also applied to the heavy fraction oil and the hydrogen donor solvent. The foamy hydrogen-containing gas 3 ascends the interior of the partition 2.

With such construction, the fluid in the cracking tower 5 is circulated in the direction of an arrow shown in the figure due to the intra-tower pressure unbalance caused by the small specific gravity of the region in which the hydrogen-containing gas 3 is present exists.

A part of the above-described circulating fluid is capable of passing through the solid catalyst-housed partition 2 from the outside of the partition 2 (the side on which the hydrogen-containing gas 3 is not present) to the interior thereof (the side on which the gas is present, in the direction shown by an arrow (dotted line). The amount of passage of the fluid changes depending on the pressure balance between the outside With such arrangement where a cylinder as the partition 2 is inserted in the cracking tower 5, it is possible to yield a circulating flow inside the tower, assure a required flow velocity, and avoid any blocking in the cracking tower 5 caused by carbonaceous materials therein.

The hydrogen-containing gas 3 rises in the cylindrical partition 2 and is exhausted from the outlet pipe 4, while the fluid circulates in the cracking tower 5 and, after a prescribed residence time, is discharged from the outlet pipe 4. Accordingly, the fluid which resides for a prescribed period of time under conditions of a prescribed temperature and pressure can be cracked to produce lighter fractions. At this point, the fluid contacts with the catalyst in the cylindrical partition 2 while circulating in the cracking tower 5, so that the cracking may be more effectively effected with the attendant remarkable reduction of production of carbonaceous materials as compared with a case in which no catalyst is used.

To obtain a satisfactory circulating flow with the structures of the cracking tower 5 and cylindrical partition 2, the symbols indicated in FIG. 1 should preferably be in the following relationships:

$e < di$ $1.01 \leqq Di/di \leqq 3.0$ $0.05 \leqq (do' - di)/2di \leqq 3.0$

The partition for housing a solid catalyst according to the present invention is porous as a whole, one part or the whole of which being composed of the solid catalyst having a hydrogenation function, while it is generally porous plain plate- or curved plate-shaped as a whole. A part or the whole of the plate is formed by an assembly of solid catalyst particles having a hydrogenation function. The partition may be illustrated by those prepared by housing at least one kind of particulate catalyst selected from extrusion molded catalyst, spherical catalyst and compression molded catalyst, in a metal mesh, punching metal or the like, and may also be illustrated by an assembly of catalyst particles bonded to each other with a binder.

The thickness of the partition for housing a solid catalyst is 1/200 to 1/5, preferably 1/100 to 1/10, of the inside diameter of the reaction tower.

The sizes of openings of the metal mesh and punching metal for housing a solid catalyst are such that solid catalyst particles do not pass through the openings and the fluid may sufficiently contact with the catalyst particles.

The amount of catalyst used in the present invention ranges from 1/100 to 1/1.5, preferably 1/50 to ½, of the internal volume of the cracking tower.

The solid catalyst is not particularly limited only if it is one having a hydrogenation function such for example as hydrocracking, hydrodemetallization, hydrodesulfurization or hydrodenitrification. But, from the viewpoint of long-term operation, the preferable catalyst is one which will not remarkably decrease in activity due to vanadium, nickel and the like contained in starting oils even if it has originally low activity.

For example, there can be used the same catalysts as employed in a heavy fraction oil treating process such as hydrocracking, hydrodesulfurization or hydrodenitrification for heavy fraction oils, or there can also be employed such catalysts already used.

In addition, it is possible to add a small quantity of a new catalyst to the above-described catalysts or to also use catalysts having relatively low activity instead of the above-described used catalysts. The solid catalysts include oxides or sulfides of a Group VIII metal such as nickel or cobalt or of a Group VI B metal such as molybdenum or tungsten, the metal oxides or sulfides being carried on an inorganic substance such as alumina, silica, silica-alumina, alumina-boria, silica-alumina-magnesia, silica-alumina-titania, or natural or synthetic zeolite.

Although the solid catalyst is not particularly limited in shape, for example an extrusion molded catalyst, a spherical catalyst or a compression molded catalyst may be used.

The diameter of the catalyst particle ranges from 0.01 to 10 mm, preferably 0.1 to 5 mm.

Operating conditions used in the present invention are as follows: reaction temperature, 380° to 470° C.; reaction pressure, 30 to 150 kg/cm$^2$.G varying depending on the kind of hydrogen-containing gas; residence time of starting heavy fraction oil in the cracking tower, preferably 0.2 to 10 hours; circulating flow speed of the fluid in the cracking tower, at least 1 cm/sec., preferably 5 to 100 cm/sec.

According to the present invention, 30 wt. % or more of heavy metals such as vanadium and nickel, etc., contained in a starting heavy fraction oil can be adhered to the catalyst in the cracking tower.

The starting oils used in the present invention include heavy fraction oils containing at least 1.0 wt. %, preferably 5 to 30 wt. %, of asphalten (pentane-insoluble ingredients), preferably 5 to 30 wt. % and comprising at least 50 wt. % of a fraction boiling above 350° C.; atmospheric or reduced pressure distillation residual oils; and oils obtained from coal, oil sand, oil shale, bitumen and the like.

One of preferable hydrogen donor solvents used in the present invention is a hydride of a polycyclic aromatic hydrocarbon. The polycyclic aromatic hydrocarbons are illustrated by those having 2 to 6 rings, preferably 2 to 4 rings and the derivatives thereof. The polycyclic aromatic hydrocarbons can be used singly or in combination. There can be listed, as examples of the polycyclic aromatic hydrocarbons, naphthalene, anthracene, phenanthrene, pyrene, naphthacene, chrysene, benzopyrene, perylene, picene and the derivatives thereof.

In addition, the hydrogen donor solvents according to the present invention further include the hydrides of hydrocarbon oils containing at least 30 wt. % of polycyclic aromatic hydrocarbons and boiling in the range of 150° to 1500° C. As examples of the hydrocarbon oils, there can be listed various products obtained from petroleum such as a cycle oil from a cat cracker (FCC), a bottom oil from a catalytic reformer or a thermally cracked oil of naphtha, or various products such as tar oil, anthracene oil, creosote oil and coal liquefied oil, each being produced from coal.

The hydrogen-containing gases used in the present invention are preferably those containing at least 70 wt. % of hydrogen gas and include hydrogen-containing gases from a reformer.

Another method for cracking heavy fraction oils according to the present invention will be further detailed below with reference to FIGS. 5 and 6.

FIG. 5 is an example of a flow chart illustrating execution of the method according to the present invention.

In FIG. 5, numeral 1 is a cracking tower, 2 hydrogenation tower, 3 a separation device, 4 an introduction passage for a starting heavy fraction oil, 5 an introduction passage for hydrogen gas, 6 and 7 effluent passages for reaction product mixtures in the cracking and hydrogenation towers, respectively, 8 a recycling flow passage for a hydrogen donor solvent from the separation device 3 to the cracking tower, and 9 and 10 product effluent passages from the separation device.

The starting heavy fraction oil is passed, together with a recycled hydrogen donor solvent from the recycle flow passage 8, to the cracking tower 1 where the cracking is effected using the hydrogen donor W solvent. The reaction in the cracking tower is carried out at preferably 380°–470° C. The supply of hydrogen to the cracking tower is effected by the hydrogen donor solvent and, therefore, it is not necessarily required to supply hydrogen gas, particularly high pressure one, from other sources. However, in order to prevent coking and make conveniently the hydrogen pressure in the cracking tower equal to that in the hydrogenation tower which is required to be high, it is preferable to introduce hydrogen gas usually from the hydrogen gas introduction passage 5 to the cracking tower and effect the reaction under a hydrogen gas pressure of 30–150 $kg/cm^2.G$.

In conventional cracking with use of a hydrogen donor solvent, it is a common practice to effect a reaction in a cracking tower in the blank state. Namely, a hydrogen donor solvent and starting oil each at a high temperature are introduced into a tower or a vessel in the blank state (without fillers and the like charged) where the cracking of the oil is effected in the presence of hydrogen liberated by the hydrogen donor solvent. In contrast, one of the characteristics of the method according to the present invention is that the solid catalyst, porous solid or both are placed in the cracking region employing the hydrogen donor solvent and then vanadium and nickel which are made apt to be removed due to cracking are allowed to adhere to the solid materials. Further, the method according to the present invention is characterized in that cracked products from the cracking tower and the hydrogen donor solvent liberating hydrogen in the cracking tower are both directly introduced into the hydrogenation tower. But, the catalyst and/or the porous material existing in the cracking tower is not introduced into the hydrogenation tower.

Namely, the whole contents (called a reaction product mixture) in the cracking tower after the reaction except the solid catalyst and porous solid are introduced into the hydrogenation tower.

As described above, in the present invention, unlike in conventional methods, the cracked products from the cracking tower are not separated by distillation and the used hydrogen donor solvent is not hydrogenated separately, but these cracked products and solvent are passed through the passage 6 from the cracking tower 1 to the hydrogenation tower 2 where the hydrogen donor solvent and the cracked products are hydrogenated in the presence of a hydrogenation catalyst. The hydrogenation in the hydrogenation tower is quite the same as that effected by the conventional fixed floor system. The hydrogenation tower effects hydrogenation at a reaction temperature of 300° to 450° C. and a hydrogen pressure of 30 to 150 $kg/cm^2.G$ in the downstream flow in the presence of a hydrogenation catalyst. Since the starting heavy fraction oil has been hydrocracked in the cracking tower, an operating condition may be mild in the hydrogenation tower. In addition, since the metals have been removed in the cracking tower, the catalystic activity will little decrease in the hydrogenation tower.

The hydrogen donative solvent is regenerated or hydrogenated due to hydrogenation in the hydrogenation tower to recover its hydrogen donative nature, while the cracked products are hydrogenated are refined to remove the impurities such as sulfur-containing and nitrogen-containing ingredients.

The reaction product mixture in the hydrogenation tower, i.e., the whole contents in this hydrogenation tower except the solid catalyst, is fed via the fluid passage 7 to the separation device 3 and then separated into desired respective fractions by a separation treatment such as distillation. The desired fractions are passed through the product effluent passage 9 to recover them as gas, a gasoline naphtha fraction, a kerosine fraction, a light oil fraction, a heavy oil fraction and the like; and the hydrogen donor solvent is recycled through the recycling passage 8 to the cracking tower. Then, make-up 11 is preferable to compensate for a loss of the hydrogen donative solvent.

The hydrogen donative solvent described above is not required to be previously hydrogenated before being introduced into the apparatus. Namely, it is hydrogenated in the hydrogenation tower to provide a new hydrogen donative solvent.

The solid catalyst and/or porous solid used in the cracking tower of the present invention is intended not only to crack heavy fraction oils, but also to collect metals, which are made apt to be removed due to cracking, by allowing them to adhere to the solid materials. In addition, it is preferable that the solid catalyst and the porous solid have high capability of attaching such metals thereto.

As the porous materials, there can be listed alumina, silica-alumina, ceramics, carbonaceous materials, clay and the like, which are inexpensive.

There is set no particular limitation on a catalyst used for in the hydrogenation tower of the present invention. Namely, catalysts generally used in hydrogenation treatment can be used for respective desired purposes. What types of catalysts may be used is dependent on the composition and properties of a starting oil to be used and desired products to be obtained.

Such reactions as effected in the first and hydrogenation towers in the present invention, although they may be executed in two separate towers, they may also be effected in one tower by dividing it into two areas for reaction, one area being for the first step reaction (cracking) and the other for the second step reaction (hydrogenation).

The above and other objects, features and advantages of the present invention will become more apparent from the following description when taken in conjunction with the accompanying drawings in which a preferred embodiment of the present invention is shown by way of illustrative examples.

BREIF DESCRIPTION OF THE DRAWINGS

FIGS. 1 to 3 are schematic views illustrating respectively cracking towers aocording to the present invention, in which (a) is a longitudinal section of the cracking tower and (b) is a cross-sectional view of the same;

FIGS. 4(*a*) and (*b*) are perspective views of a partition provided in the cracking tower, (a) cylindrical one and (b) plate-shaped one;

FIG. 5 is a block diagram illustrating a method for hydrocracking heavy fraction oils according to the present invention; and FIG. 6 is a graph illustrating variation in degree of cracking with the lapse of time in Example 2 and Comparative Example 2.

DESCRIPTION OF THE PREFERRED EMBODIMENT

EXAMPLE 1

Figure 1A:
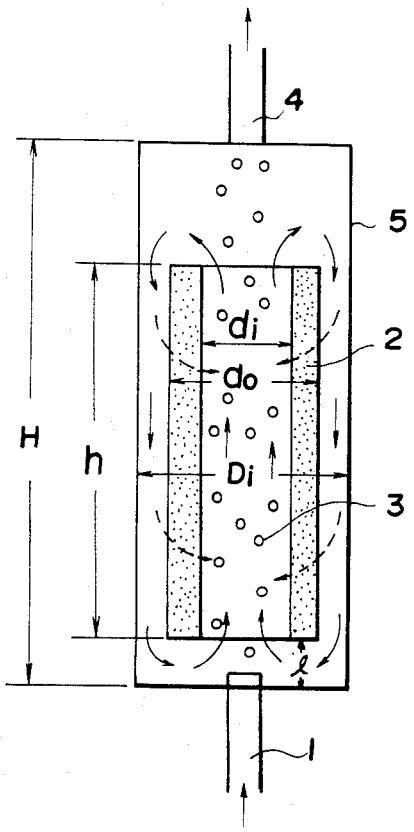
Figure 2A:
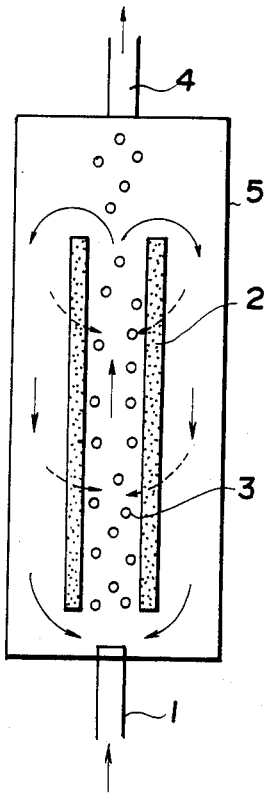
Figure 1B:
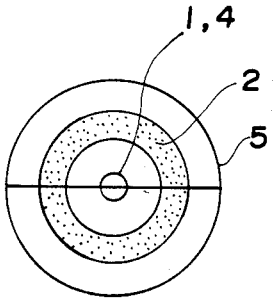
Figure 2B:
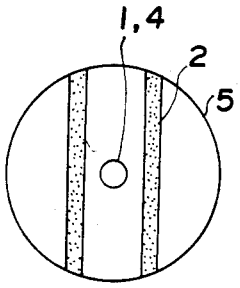
Figure 3A:
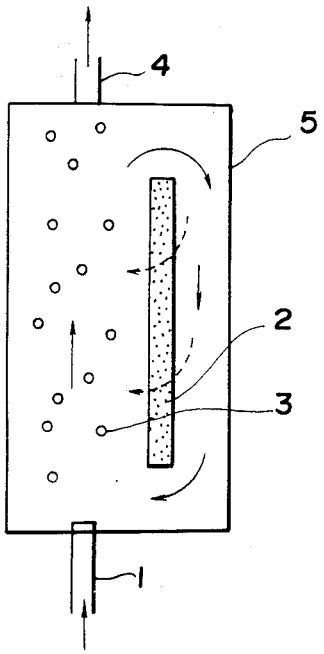
Figure 4B:
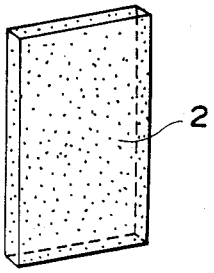
Figure 3B:
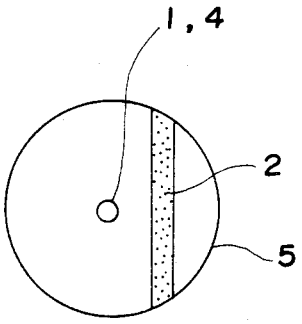
Figure 4A:
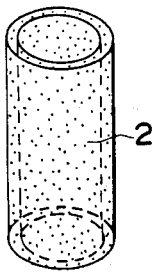
Figure 5:
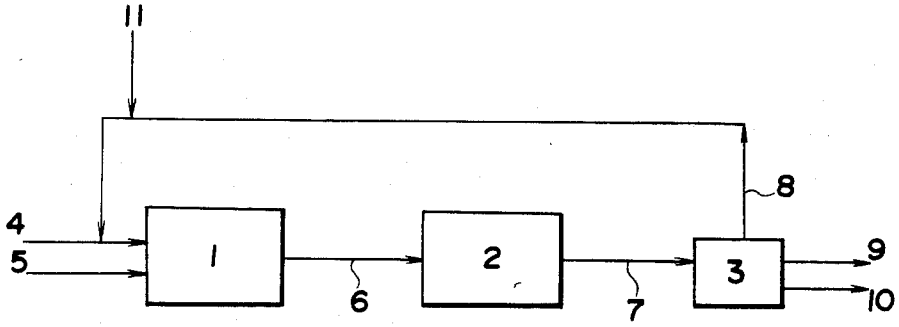

The first hydrocracking method for heavy fraction oils according to the present invention will be described below experimentally for Arabian reduced pressure residual oil with reference to the cracking tower in FIG. 1. There are shown the properties of starting oils in Table 1, the operating conditions in Table 2, and the dimensions of the cracking towers in Table 3. A cylindrical partition is provided by housing an 1/32 inch extrusion molded catalyst composed of cobalt (3.6 wt. %) and molybdenum (10.7 wt. %) carried on a silica-alumina carrier (pore volume 0.55 cc/g), surface area (93 $m^2/g$), average pore radius 62 Å) in a cylindrical metal mesh. The starting oil listed in Table 1 and a hydrogen donor solvent (tetralin) are introduced in a weight ratio of 1:1 into a cracking tower at the lower part thereof, while hydrogen gas is introduced into the cracking tower at the lower part. They are permitted to ascend only in the cylindrical partition along it. The resulting reaction products are recovered, and the tetralin is separated, and thereafter the properties of the products are measured. Although the operation of the apparatus is successively executed for 1300 hours, there is found no increase of pressure loss. The properties of the resultant products are listed in Table 1, and the mass balance and consumption of hydrogen in Table 4.

COMPARATIVE EXAMPLE 1

The cylindrical partition was removed from the apparatus shown in the Example 1, and the same starting oil was treated under the same conditions. The operation was interrupted after 420 hours because of a great increase in pressure loss. The properties of a product obtained during the operating time were shown in Table 1, and the mass balance and consumption of hydrogen shown in Table 4.

TABLE 1

| ITEM | STARTING HEAVY FRACTION OIL | EXAMPLE 1 | COMPARATIVE EXAMPLE 1 |
|---|---|---|---|
| Specific Gravity ($d_4^{15}$) | 1.030 | 0.932 | 0.940 |
| Viscosity (cSt) | 142.9 (at 160° C.) | 29.52 (at 50° C.) | 34.71 (at 50° C.) |
| Carbon Residue (wt %) | 22.31 | 8.78 | 10.62 |
| Softening Point (°C.) | 43.5 | — | — |
| Asphaltene (Pentane-Insolubles) (wt %) | 13.1 | 2.7 | 10.3 |
| Elementary Analysis (wt %) | | | |
| S | 4.80 | 0.70 | 0.81 |
| N | 0.4 | 0.15 | 0.2 |
| C | 84.3 | 86.8 | 87.4 |
| H | 10.2 | 11.9 | 11.6 |
| H/C (Atomic Ratio) | 1.45 | 1.65 | 1.58 |
| Metal (ppm) | | | |
| V | 140 | 13 | 114 |

TABLE 1-continued

| ITEM | STARTING HEAVY FRACTION OIL | EXAMPLE 1 | COMPARATIVE EXAMPLE 1 |
|---|---|---|---|
| Ni | 47 | 8 | 41 |
| Cracking Rate (wt %) | — | 83.5 | 79.6 |
| Demetallization (wt %) | — | 88.8 | 17.1 |

TABLE 2

| ITEM | EXAMPLE 1 | COMPARATIVE EXAMPLE 1 |
|---|---|---|
| Reaction Temperature (°C.) | 450 | 450 |
| Reaction Pressure ($kg/cm^2 \cdot g$) | 70 | 70 |
| Residence Time (hr) | 1.0 | 1.0 |
| Solvent | tetralin | tetralin |
| Solvent Ratio (wt ratio) Tetralin/Starting Heavy Fraction Oil | 1.0 | 1.0 |
| Hydrogen Supply ($Nm^3/Kl$) Starting Heavy Fraction Oil | 1200 | 1200 |
| Pressure Loss ($kg/cm^2 \cdot g$) after Operation Initiation | | |
| 100 hrs | 0.85 | 0.85 |
| 200 hrs | 0.90 | 1.13 |
| 400 hrs | 0.90 | 2.54 |
| Flow Velocity of circulation fluid (cm/sec) | 20 | — |

TABLE 3

| ITEM | EXAMPLE 1 | COMPARATIVE EXAMPLE 1 |
|---|---|---|
| Di | 50 | 50 |
| do | 36 | — |
| di | 22 | — |
| l | 20 | — |
| H | 3000 | 3000 |
| h | 2000 | 2000 |

(unit: mm)

TABLE 4

| ITEM | EXAMPLE 1 | COMPARATIVE EXAMPLE 1 |
|---|---|---|
| $H_2S$ | 3.51 | 3.23 |
| $NH_3$ | 0.07 | 0.07 |
| $C_1$–$C_3$ | 5.03 | 4.59 |
| Below 343° C. | 31.21 | 27.83 |
| 343/565° C. | 45.68 | 43.37 |
| Above 565° C. | 16.50 | 22.70 |
| Total | 102.0 | 101.80 |
| Chemical Consumption of Hydrogen ($Nm^3Kl$) | 262 | 237 |

(unit: wt % to starting heavy fraction oil)

The following results were obtained from Tables 1 to 4.

(1) A long-term operation is possible for the hydrocracking method according to the present invention:

In Comparative Example 1, the pressure loss in the system was gradually increased and, therefore, the operation had to be suspended 420 hours later. This was because carbonaceous materials were produced by the cracking reaction and accumulated in the cracking tower as well as in pipings located downstream of the cracking tower to prevent fluids and gases from flowing therethrough, finally blocking or clogging the tower and pipings. In contrast, in Example 1, the production of carbonaceous materials were reduced because of larger effect of the catalyst and higher flow speed of the fluid in the cracking tower, thus enabling long-term operation to be effected.

(2) The rate of cracking was higher in the method according to the present invention:

A cracking method with use of a hydrogen donor solvent generally exhibits a high cracking rate as compared with other methods. Further, the additional use of a suitable catalyst in the cracking method enables hydrogen in vapor phase to be effectively utilized. Accordingly, higher cracking rates (refer to Table 1) are obtained even under the same conditions. Namely, hydrocracking can be promoted (Table 4), while operating conditions may be made milder when the same cracking rate is desired to be obtained.

(3) Products having excellent properties can be obtained:

As shown in Table 1, in Example 1, hydrocracking can be much promoted as compared with Comparative Example 1, and the content of asphaltene above 565° C. (pentene-insolubles) is conspicuously reduced. A higher H/C ratio (atomic ratio) was found. This shows that transfer of the hydrogen to the oil is frequently effected, thereby promoting hydrogenation of products and enabling more satisfactory products to be produced.

(4) Demetallization is effected:

When a heavy fraction oil is cracked with use of a hydrogen donor solvent, metals such as vanadium and nickel, contained in the heavy fraction oil are become facilitated to be removed. At this time, demetallization may be effected owing to the presence of a catalyst. Almost all the metals remain in the products in Comparative Example 1, whereas about 90% of the metals is removed and adhered to the catalyst present there in Example 1 as is apparent from Table 1. This is very advantageous in view of the succeeding process. Namely, since these metals cause catalytic activity to be reduced, previous removal thereof benefits the successive processes in view of catalytic activity. In addition, it is preferable that the catalyst used in the cracking tower have high capability of adhering metals thereto.

EXAMPLE 2

Khafuji reduced pressure residual oil was experimentally cracked by the method of the present invention. In the cracking tower, a direct desulfurization catalyst for atmospheric pressure residual oil which had been industrially already employed for about 8,000 hours was used as a downstream fixed bed. In the hydrogenation tower, there was used an 1/16 inch extrusion molded catalyst composed of cobalt (3.5 wt. %) and molybdenum (12.0 wt. %) carried on a silica-alumina carrier (pore volume 0.6 cc/g, surface area 190 $m^2/g$, average pore radius 65 Å). As a reaction apparatus, there were used the cracking and hydrogenation towers which were each 40 mm in inside diameter and 1,300 mm in length. Each tower was filled with said catalyst so as to provide 1,000 mm of filling length. The starting oils and hydrogen gas as indicated in Table 5 were heated with a heater, and fed to the cracking tower in a downstream flow. As the hydrogen donor solvent, the bottom oil from a reforming device having the properties shown in Table 8 was employed, and make-up was used in amounts of 20 wt. % of the starting oil. The gas and liquid effluent from the hydrogenation tower were passed to a vapor-liquid separator where they were separated from each other, and thereafter the liquid was passed to a rectifying tower to recover fractions boiling in the range of from 25° to 350° C. for recycled use as a hydrogen donative solvent. The amount of solvent recycled was 1.5 times as large as that of the oil. The hydrogen gas was, after separated through the vapor-liquid separator, partly recycled and the remainder was mixed with make-up hydrogen and thereafter fed, together with the starting oil and the circulating solvent, through a heater into the cracking tower. The operation was conducted for 2,500 hours in succession.

The properties of the treated starting oil and those of the products were shown in Table 5. The operating conditions were shown in Table 6. The mass balance in the present experiment was shown in Table 7. Variation in cracking rates with the lapse of time was shown in FIG. 6. The rate of cracking was defined as follows:

$$(a-b/a)$$

a: proportion (wt. %) of fraction boiling above 565° C. in the starting oil b: proportion (wt. %) of fraction boiling above 565° C. in the product In addition, in order to estimate a rate of demetallization in the cracking tower, a liquid sample was collected and amounts of metals were measured. The result was listed in Table 9.

COMPARATIVE EXAMPLE 2

The same starting oil, apparatus, and catalyst as used in Example 2 were employed in this comparison test to conduct a hydrogenation experiment by making use of a prior fixed bed reaction device. But, the same cracking and hydrogenation towers were each charged with the same catalyst as charged in the hydrogenation tower in Example 2. There were not conducted addition of any hydrogen donor solvent to the reaction system and recycling thereof. Namely, a prior hydrocracking method using hydrogen and a proper catalyst was employed. The operation was continuously conducted for 2,500 hours, and the results were compared with those obtained in Example 2. The operating time was listed in Table 6 as well as the product properties and mass balance in Tables 5 and 7. The cracking rates varying with the lapse of time were shown in FIG. 6.

In addition, the starting oil and hydrogen gas were charged downstream as in Example 2.

Further, the cracking rate and demetallization rate at the outlet of the cracking tower were shown in Table 9.

TABLE 5

Properties of fractions above 350° C. in starting heavy fraction oils and products

| | STARTING HEAVY FRACTION OIL | EXAMPLE 2 | COMPARATIVE EXAMPLE 2 |
|---|---|---|---|
| Specific Gravity ($d_4^{15}$) | 1,028 | 0.920 | 0.931 |
| Viscosity (cSt at 100° C.) | 2,030 | 14.15 | 35.20 |
| Carbon Residue (wt %) | 21.9 | 3.51 | 6.11 |
| Fluid Point (°C.) | +45 | — | — |
| Pentane-Insolubles (wt %) | 9.9 | 2.3 | 7.8 |
| Elementary Analysis (wt %) | | | |
| S | 5.30 | 1.19 | 0.91 |
| N | 0.40 | 0.22 | 0.17 |

TABLE 5-continued

| Properties of fractions above 350° C. in starting heavy fraction oils and products | STARTING HEAVY FRACTION OIL | EXAMPLE 2 | COMPARATIVE EXAMPLE 2 |
|---|---|---|---|
| C | 84.3 | 88.3 | 88.0 |
| H | 10.5 | 9.5 | 10.2 |
| Metal (ppm) | | | |
| V | 131 | 20 | 49 |
| Ni | 39 | 11 | 25 |
| Composition analysis of fractions below 250° C. | | | |
| Saturated fractions | — | 80.5 | 83.1 |
| Olefin fraction | — | 0.2 | 0.1 |
| Aromatic fraction | — | 19.3 | 16.8 |

TABLE 6

| Operating Conditions | EXAMPLE 2 | COMPARATIVE EXAMPLE 2 |
|---|---|---|
| Reaction Temperature (°C.) | | |
| Cracking tower | 440 | 400 |
| Hydrogenation tower | 340 | 400 |
| Reaction Pressure ($kg/cm^2$ g) | 60 | 167 |
| LHSV (Charged starting amount/amount of catalysis) ($hr^{-1}$) | 0.3 | 0.2 |
| Hydrogen Supply $Nm^3/m^3$ starting heavy fraction oil) | 500 | 1,000 |
| Hydrogenative Solvent | Bottom oil in a reforming tower (See Table 9) | none |
| Circulation fluid amount ($m^3/m^3$ starting heavy fraction oil) | 1.5 | none |

TABLE 7

| Mass Balance and Consumption of Hydrogen | EXAMPLE 2 | COMPARATIVE EXAMPLE 2 |
|---|---|---|
| | wt %/starting oil | wt %/starting oil |
| $H_2S$ | 4.3 | 4.5 |
| $NH_3$ | 0.2 | 0.3 |
| $C_1$-$C_4$ | 4.9 | 7.1 |
| 343° C.− | 38.1 | 26.1 |
| 343° C./565° C. | 38.4 | 29.8 |
| 565° C.+ | 16.1 | 37.0 |
| Total | 102.0 | 104.8 |
| Chemical Consumption of Hydrogen ($m^3$/Kl-starting oil) | 121 | 150 |

TABLE 8

| Properties of Solvent | |
|---|---|
| Specific Gravity ($d_4^{15}$) | 1,010 |
| Refractive Index (−) | 1,603 |
| Bromination Value (−) | 3.0 |
| Viscosity at 37.8° C. | 3.15 |
| (cSt) at 98.9° | 1.14 |
| Structural Analysis | |
| % CA (Aromatic compound) | 73.5 |
| % CN (Naphthene compound) | 13.6 |
| % Cp (Paraffin compound) | 12.7 |

TABLE 8-continued

| Properties of Solvent | |
|---|---|
| Fractionation Properties (°C.) | |
| IBP | 235 |
| 5 | 246 |
| 10 | 251 |
| 20 | 256 |
| 30 | 261 |
| 40 | 267 |
| 50 | 274 |
| 60 | 282 |
| 70 | 291 |
| 80 | 306 |
| 90 | 337 |
| EP | 378 |

TABLE 9

| Cracking Rate and Demetallization Rate in Cracking Tower | EXAMPLE 2 | COMPARATIVE EXAMPLE 2 |
|---|---|---|
| Cracking Rate (%) | | |
| Outlet of cracking tower | 76 | 32 |
| Outlet of hydrogenation tower | 81 | 51 |
| Demetallization rate | | |
| Metal Amount in Starting Oil | | |
| V (ppm) | 131 | 131 |
| Ni (ppm) | 39 | 39 |
| Outlet of cracking tower | | |
| Metal (ppm) and Demetallization rate (%) | | |
| V (ppm) | 22 (83.2%) | 65 (50.4%) |
| Ni (ppm) | 12 (69.2%) | 30 (23.1%) |

(driving hrs. 2,000 hr)

Advantages of the method for cracking heavy fraction oils with use of a hydrogen donor solvent according to the present invention are as follows:

(1) The cracking is effective:

Cracking can be effectively conducted in the presence of any suitable catalyst. Namely, compared with the absence of any catalyst (only a starting oil, hydrogen donative solvent and hydrogen gas are present), the presence of such a catalyst can improve a cracking rate under the same conditions except the catalyst, permitting high quality products to be yeilded.

(2) Inhibition of production of carbonaceous materials:

Production of carbonaceous materials causes some problems as to the cracking of heavy fraction oils with use of a hydrogen donor solvent. The presence of even slight catalytic action greatly suppresses the production of carbonaceous materials. Thus, blocking due to carbonaceous materials produced is conspicuously reduced.

(3) Increase of pressure loss in the cracking tower can be eliminated:

When cracking of a heavy fraction oil is intended using a hydrogen donor solvent, they are required to reside in the cracking tower for a certain time (generally over 30 minutes). Accordingly, a fluid velocity in the cracking tower is not high in general methods, resulting in the production of carbonaceous materials which will cause blocking. In the method according to the present invention, there is formed a natural circulating flow in the cracking tower, so that a fluid velocity is made high to eliminate the problem described above. In addition, in the method of the present invention, a main stream of fluid does not pass through the catalyst layer. Consequently, there is no direct relationship between the increase of pressure loss in the catalyst layer and flows of the starting oil and hydrogen donor solvent. Thus, the cracking of the heavy fraction oil in the reaction tower will not be hindered due to an increase in pressure loss in the catalyst layer.

(4) Demetallization is effected simultaneously with cracking of a heavy fraction oil:

The present inventor has found experimentally as described before that upon cracking a heavy fraction oil using a hydrogen donor solvent, metals, such as vanadium and nickel, contained in the heavy fraction oil are facilitated to be removed. There exists a suitable catalyst in the cracking tower in the present method. Accordingly, metals facilitated to be removed due to cracking of the heavy fraction oil can be eliminated by the catalyst, thereby to achieve demetallization. Namely, a cracked product obtained by the method of the present invention has a low metal content, this being very advantageous for the succeeding processes.

(5) The cracking tower can be simplified in structure:

Cracking of a heavy fraction oil using a hydrogen donor solvent is conducted under a pressure of hydrogen. Accordingly, the cracking tower is at high pressure. It may also be possible to execute cracking in the presence of a catalyst fluidized in order to avoid an increase of pressure loss in the cracking tower. There are raised, however, various problems because the apparatus is complicated and is a high-pressure apparatus. The method of the present invention can be executed without applying any processing to the high-pressure apparatus and only with insertion of a molded solid catalyst into the cracking tower. Consequently, the apparatus can be much simplified in structure and also economized.

Figure 6:
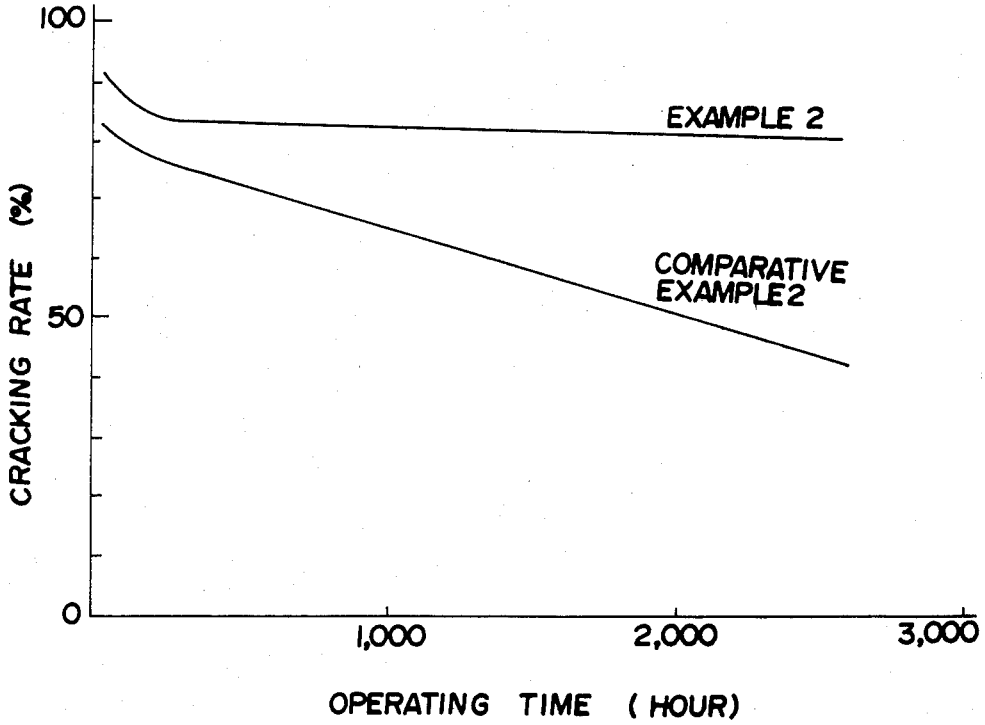

Likewise, advantages of the second method for cracking a heavy fraction oil according to the present invention by making use of a solid catalyst and porous solid are as follows:

(1) Reduction of catalytic activity in the method according to the present invention is slight:

As shown in FIG. 6, there is found slight reduction of cracking rate in Example 2, but found remarkable reduction in Comparative Example 2. It is clear that this will be caused by activity reduction of a catalyst. The cracking tower in Example 2 forms a cracking region using a hydrogen donative solvent, in which region the cracking can be promoted without any catalyst with the result that a cracking rate of 76% is reached and removal of 80% of metals is achieved. Accordingly, there is very little adhesion of the metals, such as vanadium and nickel to the catalyst in the hydrogenation tower, resulting in very slight activity reduction of the catalyst. In addition, the temperature in the hydrogenation tower is 340° C. in Example 2 and low as compared with 400° C. in Comparative Example 2. Consequently, the reduction of activity due to carbonaceous materials produced from asphaltene is also low. For these reasons, there is little reduction of cracking rate with the lapse of operation time in Example 2; but the reduction in Comparative Example 2 is remarkable.

(2) The cracking rate obtained by the present method is high:

The present method allows a large supply of oils as compared with Comparative Example 2 (in Table 6, LHSV=0, but 0.2 in Comparative Example 2) and, nevertheless, exhibits a high cracking rate (Table 9 and FIG. 6). This indicates that the cracking in the cracking tower is remarkable and the effect of a hydrogen donative solvent on the cracking is large.

(3) The present method can be executed at a low reaction pressure:

As shown in Table 6, the reaction pressure is 60 $kg/cm^2.G$ in Example 2 (167 $kg/cm^2.G$ in Comparative Example 2). Since, basically, transfer of hydrogen can be performed in liquid phase when a hydrogen donative solvent is used, the cracking can be sufficiently effected at such a low pressure as to keep the hydrogen donor solvent in the liquid phase without requiring such a high pressure as to use hydrogen in vapor phase. In addition, since, in the hydrogenation tower according to the present method, an oil already cracked is, as shown in Table 9, subjected to hydrogenation treatment and a used hydrogen donor solvent is hydrogenated, no high pressure is required and thus a pressure as used in Example 2 is sufficient for the present purposes.

(4) The consumption of hydrogen is lessened:

As shown in Table 7, the consumption of hydrogen is lessened in spite of achieving a high cracking rate. The reasons for this are as follows: In the first step reaction tower, hydrogen is transferred in liquid phase whereby the cracking can be effectively effected and there is a lessened consumption of hydrogen regardless of the high cracking rate. In addition, in the hydrogenation tower, hydrogenation of the already cracked oil is effected whereby the cracking reaction is conducted at a relatively low temperature with the attendant reduced consumption of hydrogen, and further hydrogenation of the used hydrogen donative solvent can be conducted with high efficiency, resulting in economizing hydrogen. Thus, it is possible to crack heavy fraction oils effectively even if the total consumption of hydrogen in the cracking and hydrogenation towers is reduced.

Although certain embodiments have been shown and described, it should be understood that many changes and modifications may be made therein without departing from the scope of the appended claims.

What is claimed is:

1. A method for cracking a heavy oil containing heavy metals and at least 1% by weight of asphaltene comprising the steps of:

(a) vertically dividing the interior of a cracking tower into at least two portions with a porous partition housing a solid catalyst having a hydrogenation function;

(b) communicating said divided portions with each other at the upper and lower parts thereof;

(c) introducing a heavy fraction oil, a hydrogen donor solvent and a hydrogen-containing gas into said cracking tower at the lower part of at least one of said divided portions and letting said heavy fraction oil, said hydrogen donor solvent and said hydrogen containing gas ascend through said at least one portion, removing the hydrogen containing gas from the top of said cracking tower, whereby a pressure difference exists between the outside of said partition and the interior thereof;

(d) circulating a fluid including said heavy oil, hydrogen donor solvent between said at least one portion and the other divided portion and only part of said fluid goes through from the outside of said partition to the interior of said partition.

2. The method according to claim 1, wherein the reaction temperature in said cracking tower is kept at 380°–470° C.

3. The method according to claim 1, wherein the pressure in said cracking tower is kept at 30–150 kg/cm$^2$. G by the hydrogen-containing gas.

4. The method according to claim 1, wherein the fluid circulates at a flow rate of at least 1 cm/sec. in said cracking tower.

5. The method according to claim 1, wherein the residence time of the heavy oil in said cracking tower ranges from 0.2 to 10 hours.

6. The method according to claim 1, wherein said hydrogen donor solvent is a hydride of a polycyclic aromatic hydrocarbon.

7. The method according to claim 1, wherein said hydrogen donor solvent is a hydride of a hydrocarbon oil containing at least 30% by weight of polycyclic aromatic hydrocarbons.

8. The method according to claim 1, wherein at least 30 wt. % of metals contained in said heavy oil is removed by the catalyst in the cracking tower.

9. The method according to claim 1, wherein said partition for housing said solid catalyst comprises a wire guage and porous metal plate including therein at least one kind of a particulate catalyst which is an extrusion molded catatlyst, a spherical catalyst or a compression molded catalyst.

10. The method according to claim 1, wherein said partition for housing the solid catalyst comprises an assembly of catalyst particles combined with each other with a binder.

11. The method according to claim 1 wherein said heavy oil contains at least 50% of a fraction of b.p. higher than 350° C.

12. The method according to claim 1 wherein said catalyst is a member selected from the group consisting of oxides and sulfides of a metal of Group VIII and Group VI on alumina, silica, silica-alumina, alumina-boria, silica-alumina-boria, silica-alumina-magnesia, silica-alumina-titania, natural zeolite or synthetic zeolite.

13. The method according to claim 1 which is carried out continuously.

14. The method according to claim 4 wherein the flow rate of said fluid is 5–100 cm/sec.

15. The method according to claim 1 wherein said partition is a cylindrical partition.

16. The method according to claim 1 wherein after residence time of at least 30 minutes said cracking tower said fluid is discharged from the top thereof.

17. The method according to claim 16 wherein said fluid discharged from the top of said cracking tower is fractionated into a fraction containing the hydrogen donor solvent and said hydrogen donor solvent is recycled.

* * * * *